US008604763B2

(12) United States Patent
Gurcan

(10) Patent No.: US 8,604,763 B2
(45) Date of Patent: Dec. 10, 2013

(54) POWER DELIVERY SYSTEM WITH SURGE HANDLING CAPABILITY

(75) Inventor: Hakan Ates Gurcan, Los Gatos, CA (US)

(73) Assignee: Decicon, Inc., San Jose, CA (US)

( * ) Notice: Subject to any disclaimer, the term of this patent is extended or adjusted under 35 U.S.C. 154(b) by 377 days.

(21) Appl. No.: 12/873,092

(22) Filed: Aug. 31, 2010

(65) Prior Publication Data

US 2011/0074368 A1 Mar. 31, 2011

Related U.S. Application Data

(60) Provisional application No. 61/238,589, filed on Aug. 31, 2009.

(51) Int. Cl.

| | |
|---|---|
| ***G05F 1/56*** | (2006.01) |
| *G05F 1/563* | (2006.01) |
| *G05F 1/565* | (2006.01) |

(52) U.S. Cl.

USPC ..... 323/282; 323/240; 323/246

(58) Field of Classification Search

USPC ..... 323/234, 240–241, 243, 246, 271, 323/274–275, 281–285

See application file for complete search history.

(56) References Cited

U.S. PATENT DOCUMENTS

| | | | | |
|---|---|---|---|---|
| 3,978,393 | A * | 8/1976 | Wisner et al. | 323/272 |
| 6,366,070 | B1 * | 4/2002 | Cooke et al. | 323/284 |
| 6,636,025 | B1 * | 10/2003 | Irissou | 323/313 |
| 6,661,679 | B1 * | 12/2003 | Yang et al. | 363/41 |
| 6,788,038 | B1 * | 9/2004 | Bell et al. | 323/284 |
| 6,806,694 | B2 * | 10/2004 | Rupp et al. | 323/282 |
| 7,579,818 | B2 * | 8/2009 | Ball et al. | 323/284 |
| 2009/0027930 | A1 * | 1/2009 | Usui | 363/84 |
| 2009/0190377 | A1 * | 7/2009 | Wang et al. | 363/21.1 |
| 2010/0194367 | A1 * | 8/2010 | Lund et al. | 323/284 |

* cited by examiner

*Primary Examiner* — Adolf Berhane
*Assistant Examiner* — Nusrat Quddus
(74) *Attorney, Agent, or Firm* — Kilpatrick Townsend and Stockton LLP

(57) ABSTRACT

A sensing circuit senses a load current to generate a sensed signal. A comparator's output is set to a first value if the sensed signal is equal to or greater than a reference signal, and to a second value if the sensed signal is smaller than the reference signal. A one-shot timer generates a logic signal that transitions from a first state to a second state in response to a first occurrence of the first value of the comparator's output, or optionally in response to each subsequent occurrence of the first value of the comparator's output if the one-shot timer is rearmed. A selector sets a first limit for the current delivered to the load in response to the first state of the logic signal, and a second limit for the current delivered to the load in response to the second state of the logic signal.

14 Claims, 7 Drawing Sheets

POWER DELIVERY SYSTEM WITH SURGE HANDLING CAPABILITY

CROSS-REFERENCES TO RELATED APPLICATIONS

The present application claims benefit under 35 USC 119 (e) of U.S. provisional application No. 61/238,589, filed Aug. 31, 2009, entitled "Current Limited Switch with Surge Handling Capability," the content of which is incorporated herein by reference in its entirety.

BACKGROUND OF THE INVENTION

A power delivery system receives power from a source connected to its input terminals and delivers current to a load connected across its output terminals. Examples of power delivery systems include voltage regulators, such as switching DC/DC converters, linear regulators, and load switches.

It is often desired that protection features be implemented in the power delivery system to improve system performance and reliability. One such feature is the current limiting function of the power delivery system. Current limiting function limits the load current to a predetermined safe level under potential overload fault conditions, such as when the output is short circuited to the ground. During normal operations, when the required load current is below the current limit level, the current limiting function does not affect the operation of the power delivery system.

The characteristics of certain loads may exhibit temporary high current requirements beyond the nominal current limit, even during a normal operation. For example, inertial loads, such as electric motors, usually require a higher current during the spin-up phase than the steady-state phase. To supply loads when there is a surge in their current requirements, it is desirable that the power delivery system temporarily increase its output current to a level above the nominal current limit. Disabling the current limit function temporarily to allow for current surges is unsafe as it would leave the power delivery system unprotected and expose it to potentially destructive conditions.

FIG. 1 shows a conventional power control block 100 of a power delivery system delivering current to a load 150. Power control block 100 receives power via its input terminal IN, and in response, delivers power to load 150 via its output terminal OUT. The power delivery system (not shown) may be a voltage regulator, such as a switching DC/DC converter, a linear regulator or it can be a power switch. Power control block 100 includes a current limiting function which limits the output current $I_{OUT}$ to a level defined by reference signal CLIMREF applied to input terminal CLIMREF of power delivery system 100.

In order to successfully handle current surges, the current limit reference signal CLIMREF must be selected such that the resulting current limit level is higher than the expected current surge required by load 150. Since the relatively high current limit defined by CLIMREF is active even after the surge dissipates, power delivery system 100 and its input supply are exposed to higher than nominal current levels under overload fault conditions, such as when the output is shorted to ground. A need continues to exist for a power delivery system that does not suffer from the disadvantages of conventional power delivery systems and is protected during overload fault conditions at all times even when there is a surge in the required current level.

BRIEF SUMMARY OF THE INVENTION

A power delivery system, in accordance with one embodiment of the present invention, includes, in part, a control block, a sensing circuit, a comparator, a one-shot timer, and a signal selector. The control block receives power and, in response, delivers a current to a load. The sensing circuit senses the current delivered to the load and generates a sensed signal in response. The comparator compares the sensed signal to a reference signal to generate a compare signal. The compare signal is set to a first value if the comparator detects that sensed signal is equal to or greater than the reference signal. The compare signal is set to a second value if the comparator detects that sensed signal is smaller than the reference signal. The one-shot timer generates a logic signal that transitions from a first logic state to a second logic state for a predefined time period in response to a first occurrence of the first value of the compare signal. The signal selector selects a first current limit reference signal in response to the first logic state of the one-shot timer. The signal selector selects a second current limit reference signal in response to the second logic state of the one-shot timer. The control block sets a first current limit for the current it delivers to the load in response to receiving the first current limit reference signal from the signal selector. The control block sets a second current limit for the current it delivers to the load in response to receiving the second current limit reference signal from the signal selector. The second current limit is higher than said first current limit. In some embodiments, the reference signal received by the comparator and the first current limit reference signal selected by the signal selector have substantially the same value.

A power delivery system, in accordance with another embodiment of the present invention, includes, in part, a control block, a sensing circuit, first and second comparators, a one-shot timer, and a signal selector. The control block receives power and, in response, delivers a current to a load. The sensing circuit senses the current delivered to the load and generates a sensed signal in response.

The first comparator compares the sensed signal to a first reference signal and generates a first compare signal in response. The first compare signal has a first value if the first comparator detects that sensed signal is equal to or greater than the first reference signal. The first compare signal has a second value if the comparator detects that sensed signal is smaller than the first reference signal.

The second comparator compares the sensed signal to a second reference signal and generates a second compare signal in response. The second compare signal has a first value if the second comparator detects that sensed signal is equal to or greater than the second reference signal. The second compare signal has a second value if the second comparator detects that sensed signal is smaller than the second reference signal.

The one-shot timer generates a logic signal that transitions from a first logic state to a second logic state for a predefined time period in response to a first occurrence of the first value of the first compare signal. The one-shot timer also generates a logic signal that transitions from a first logic state to a second logic state for a predefined time period in response to each subsequent occurrence of the first value of the first compare signal if prior to or during each subsequent occurrence of the first value of the first compare signal the second compare signal receives the second value.

The signal selector selects a first current limit reference signal in response to the first logic state of the one-shot timer, and a second current limit reference signal in response to the second logic state of the one-shot timer. The control block sets a first current limit for the current it delivers to the load in response to receiving the first current limit reference signal. The control block sets a second current limit for the current it delivers to the load in response to receiving the second current limit reference signal. The second current limit is higher than the first current limit. In some embodiments, the first current limit reference signal has a value equal to the value of the first reference signal. In some embodiments, the first current limit reference signal, the first reference signal and the second reference signal have same values.

A method of limiting a current delivered to a load, includes, in part, sensing the current delivered to the load and generating a compare signal in response, setting the compare signal to a first value if the current delivered to the load is detected as being equal to or greater than a first current sense value, setting the compare signal to a second value if the current delivered to the load is detected as being smaller than the first current sense value, causing a logic signal to transition from a first logic state to a second logic state for a predefined time period in response to a first occurrence of the first value of the compare signal, setting a first current limit value for the current delivered to the load in response to the first logic state of the logic signal, and setting a second current limit value for the current delivered to the load in response to the second logic state of the logic signal. The second current limit is greater than the first current limit. In some embodiment, the method further includes, in part, setting the first current sense value equal to the first current limit value.

A method of limiting a current delivered to a load, includes, in part, sensing the current delivered to the load to generate first and second compare signals, setting the first compare signal to a first value if the current delivered to the load is detected as being equal to or greater than a first current sense value, setting the first compare signal to a second value if the current delivered to the load is detected as being smaller than the first current sense value, setting the second compare signal to a third value if the current delivered to the load is detected as being equal to or greater than a second current sense value, setting the second compare signal to a fourth value if the current delivered to the load is detected as being smaller than the second current sense value, causing a logic signal to transition from a first logic state to a second logic state for a predefined time period in response to a first occurrence of the first value of the first compare signal, causing the logic signal to transition from the first logic state to the second logic state for the predefined time period in response to each subsequent occurrence of the first value of the first compare signal if prior to or during each subsequent occurrence of the first value of the first compare signal the second compare signal receives the fourth value, setting a first current limit value for the current delivered to the load in response to the first logic state of the logic signal, and setting a second current limit value for the current delivered to the load in response to the second logic state of the logic signal. The value of the second current limit is greater than the value of the first current limit.

In some embodiments, the method further includes, in part, setting the first current sense value equal to the first current limit value. In some embodiments, the method further includes, in part, setting the second current sense value equal to the first current limit value.

DETAILED DESCRIPTION OF THE INVENTION

Figure 1:
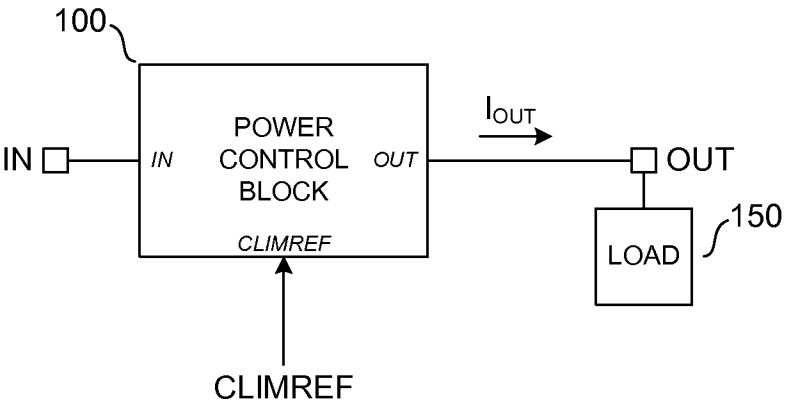
FIGURE 1 PRIOR ART
FIG. 1 shows a power delivery system, as known in the prior art.
Figure 2:
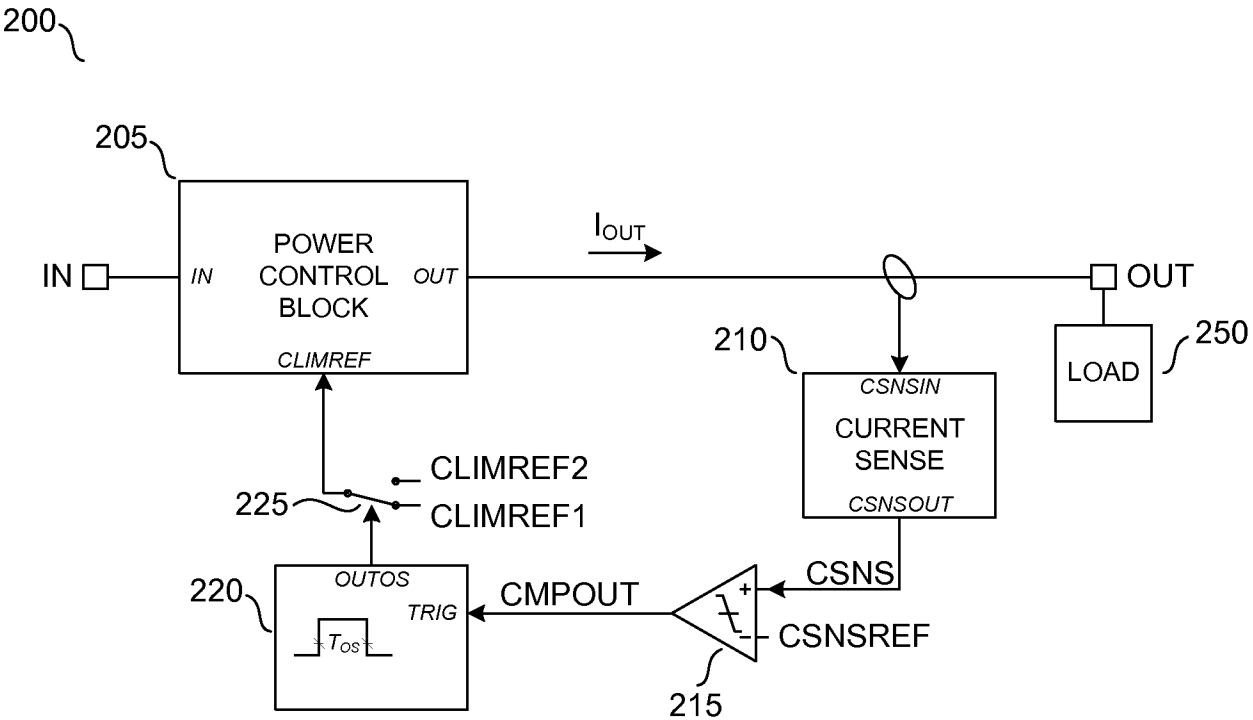
FIG. 2 is a block diagram of a power delivery system, in accordance with one embodiment of the present invention.

FIG. 2 is a block diagram of a power delivery system 200, in accordance with one embodiment of the present invention. Power delivery system 200 is shown as including a control block 205, a current sensing block 210, a comparator 215, a one-shot timer 220, and a signal selector 225. Current sense block 210 is adapted to sense the output current $I_{OUT}$ at its input terminal and generate a corresponding sense signal CSNS at its output terminal. Signal CSNS thus has a value representative of the value of sensed current $I_{OUT}$. Comparator 215 compares the sensed signal CSNS to a reference signal CSNSREF. Reference signal CSNSREF has a value representative of the value of a reference current signal $I_{CNSREF}$. If signal CSNS is detected as having a value higher than the value of signal CSNSREF, the output of comparator 215 is at a high level. If signal CSNS is detected as having a value lower than signal CSNSREF, the output of comparator 215 is at a low level.

The output signal of comparator 215, namely compare signal CMPOUT, is applied to the input terminal TRIG of one-shot timer 220. One-shot timer 220 is adapted to generate a logic signal at its output terminal OUTOS that stays high for a predefined time period $T_{OS}$ when signal CMPOUT goes from a low level to a high level. In one embodiment, one-shot timer 220 can be triggered only once. Therefore, in such embodiments, one-shot timer 220 generates a logic high signal at its OUTOS output in response to the first trigger signal received at its TRIG input (i.e., a first low-to-high transition of compare signal CMPOUT), and ignores any subsequent trigger signals until the system in which power delivery system 200 is disposed is reset. In other embodiments, one-shot timer 220 may be triggered every time signal CMPOUT transitions from, e.g., a low level to a high level.

Signal selector 225 selects one of two current limit reference signals CLIMREF1 or CLIMREF2, in response to the output signal of the one-shot timer 220, and supplies the selected current limit reference signal to control block 205. The current limit level of control block 205 is set to $I_{CLIMREF2}$ when control block 205 receives signal CLIMREF2. The current limit level of control block 205 is set to $I_{CLIMREF1}$ when control block 205 receives signal CLIMREF1. Current limit level $I_{CLIMREF2}$ is higher than $I_{CLIMREF1}$. When output signal OUTOS of one-shot timer 220 is low, the signal selector 225 selects and supplies signal CLIMREF1 to input terminal CLIMREF of control block 205. When output signal OUTOS of one-shot timer 220 is high, signal selector 225 selects and supplies signal CLIMREF2 to input terminal CLIMREF of control block 205. Thus in embodiments in which one-shot timer 220 can be triggered only once, when one-shot timer 220 is triggered for the first time (first occurrence of the low-to-high transition of signal CMPOUT), control block 220 receives the current limit reference signal CLIMREF2 at its input terminal CLIMREF for $T_{OS}$ time period. Thereafter, control block 220 receives current limit reference signal CLIMREF1. Consequently, when the output current demand goes above $I_{CSNSREF}$, power delivery system 200 enables output currents of up to $I_{CLIMREF2}$ for $T_{OS}$ seconds, and then reverts back to its nominal current limit level of $I_{CLIMREF1}$.

Figure 3:
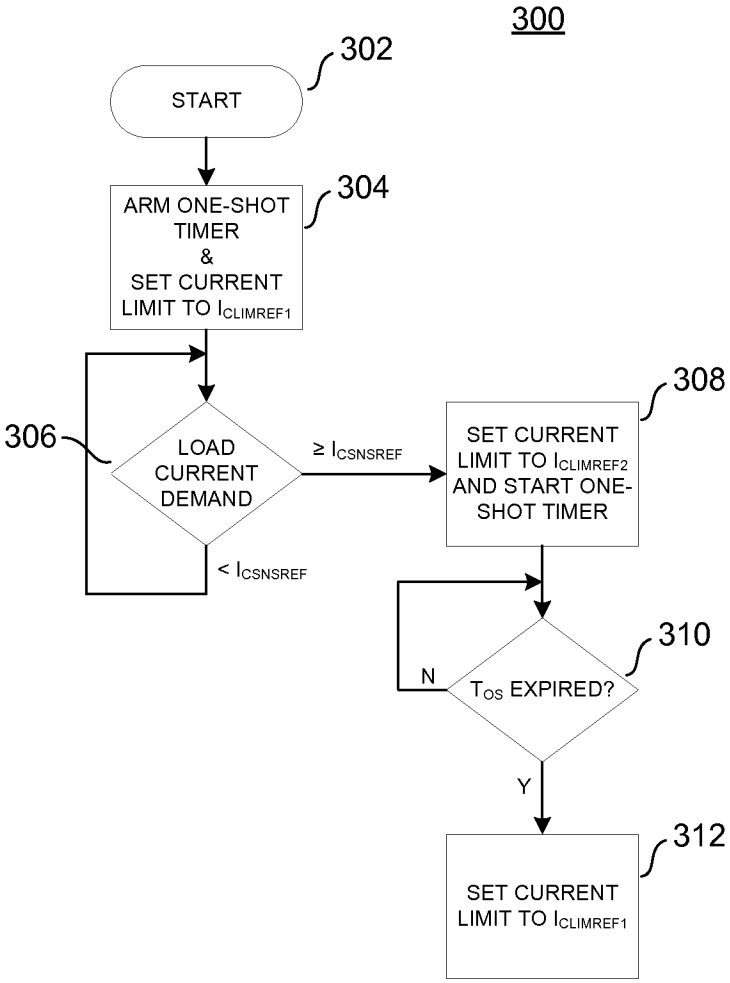
FIG. 3 is a flow chart of steps performed by a power delivery system, in accordance with one embodiment of the present invention.

FIG. 3 is a flowchart 300 of steps carried out by a power delivery system, in accordance with one embodiment of the present invention. At the start 302 of operation, which may be when the power delivery system 200 is turned on from an off state, a one-shot timer is armed and the current limit level is set 304 to a first level $I_{CLIMREF1}$. If the load current demand is sensed 306 to be equal to or greater than a reference current $I_{CSNSREF}$, the one-shot timer is triggered and the current limit level is set 308 to $I_{CLIMREF2}$ for a period of $T_{OS}$ seconds. When the one-shot timer expires 310 (period $T_{OS}$ ends) the current limit level is set back 312 to $I_{CLIMREF1}$. Thus, loads which require higher than nominal current levels during their start-up phase can be supported without compromising system protection against unexpected overload fault conditions. If the load current demand is sensed 306 to be less than the reference current $I_{CSNSREF}$, the current limit level remains at $I_{CLIMREF1}$.

Figure 4:
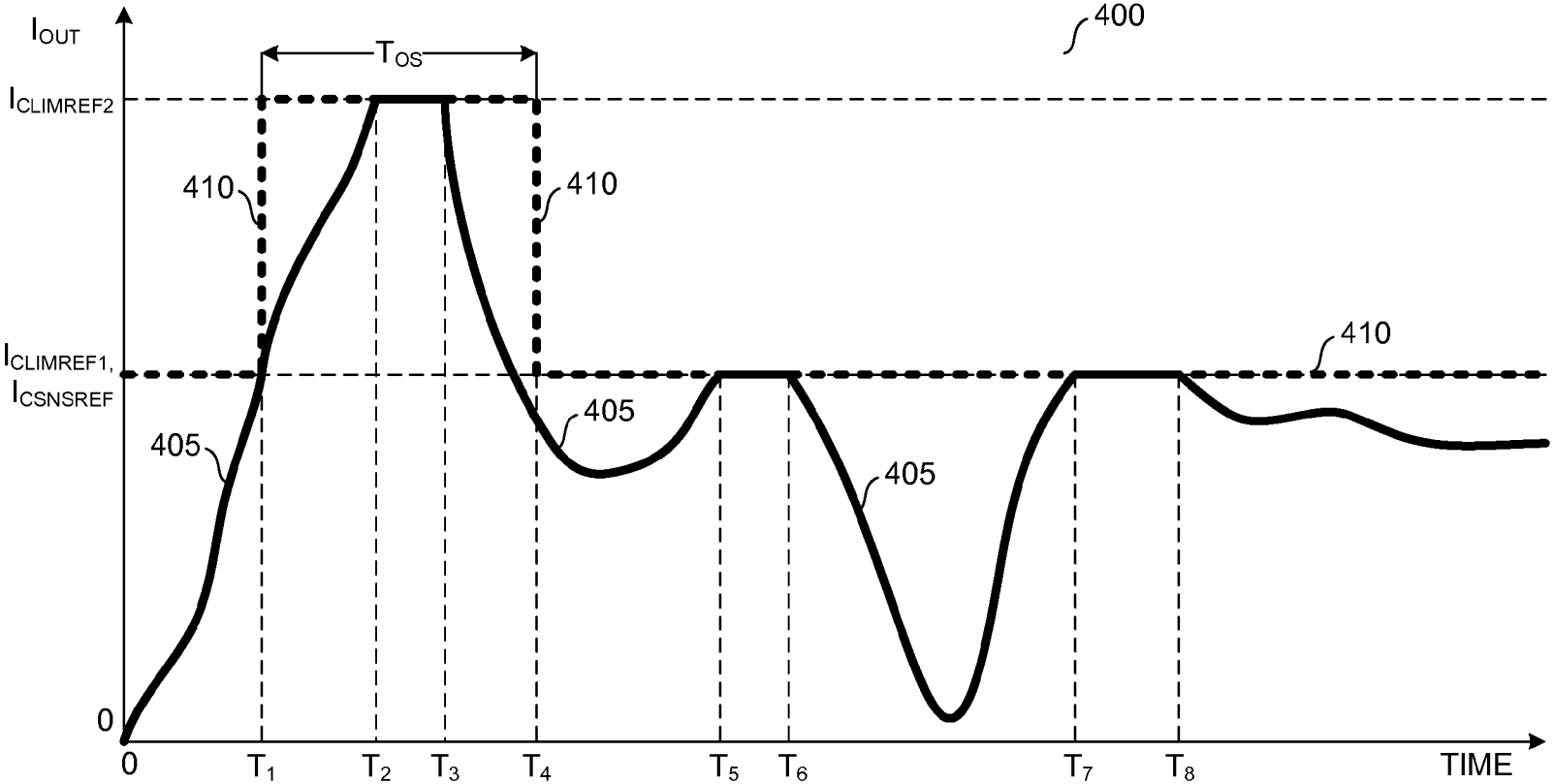
FIG. 4 is an exemplary timing diagram of a number of signals associated with the power delivery system of FIG. 2, in accordance with one embodiment of the present invention.

FIG. 4 is an exemplary timing diagram 400 of output current (solid line) 405 and the current limit level (dashed line) 410 of power delivery system 200. For simplicity, currents $I_{CLIMREF1}$ and $I_{CSNSREF}$ are selected to be equal. At time zero, the current limit level is set to $I_{CLIMREF1}$ and the output current $I_{OUT}$ is shown as increasing. When $I_{OUT}$ reaches $I_{CSNSREF}$ at time $T_1$, the current limit level increases from $I_{CLIMREF1}$ to $I_{CLIMREF2}$ for a period of $T_{OS}$ seconds. Between the times $T_2$ and $T_3$, the output current $I_{OUT}$ is limited to $I_{CLIMREF2}$ even though the load current demand exceeds $I_{CLIMREF2}$. Once $T_{OS}$ expires at time $T_4$ the current limit level reverts back to its nominal value of $I_{CLIMREF1}$. Subsequent load current demands which exceed $I_{CSNSREF}$ do not cause an increase in the current limit level since the one-shot timer can only be triggered once for the exemplary timing diagram shown in FIG. 4. For example during the periods $T_6-T_5$ and $T_8-T_7$, the required load current is limited to $I_{CLIMREF1}$. The power delivery system thus enables a higher than nominal load current to flow unimpeded during an initial current surge window and then limits the load current to a nominal level for the rest of its operation in some embodiments.

Figure 5:
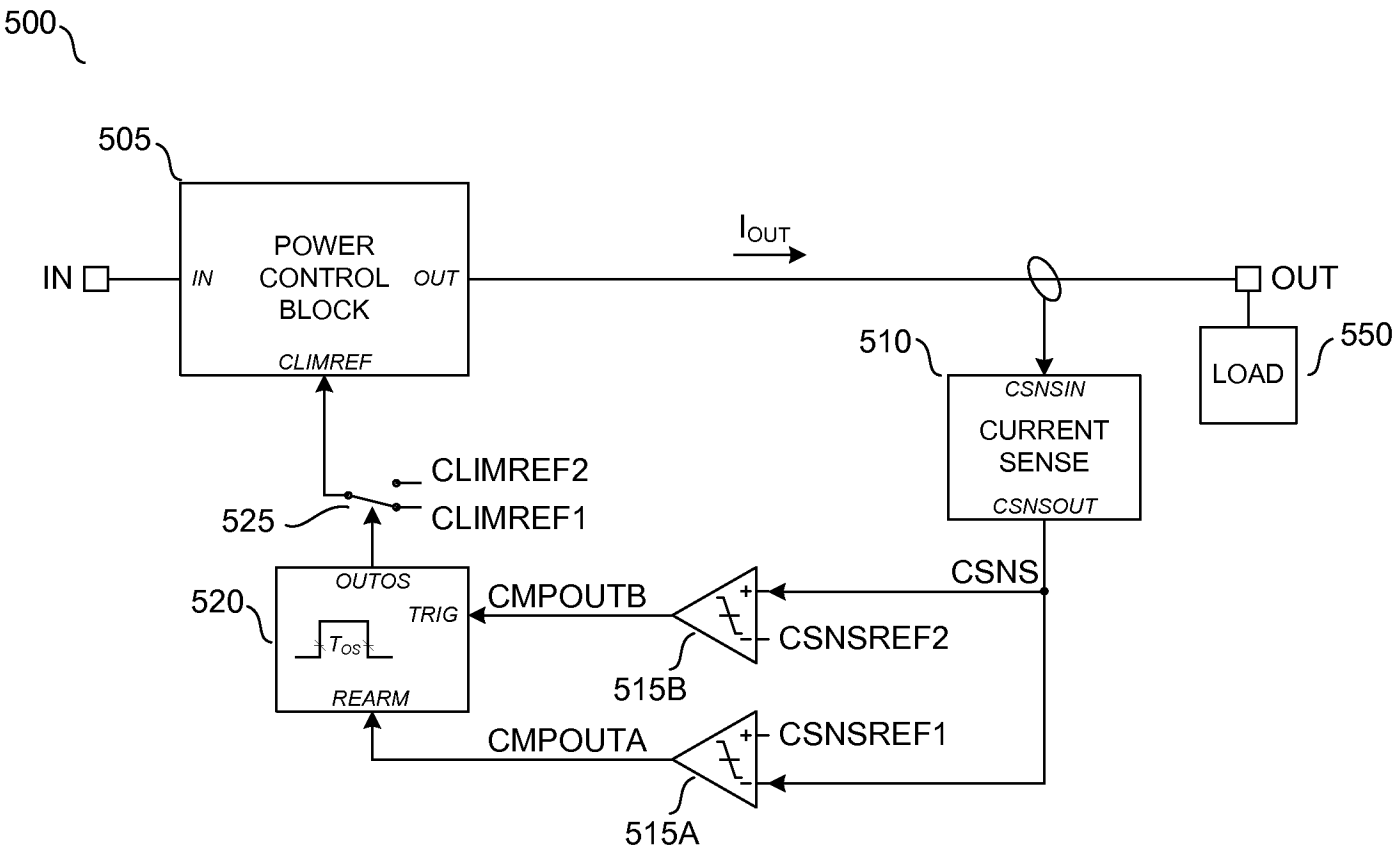
FIG. 5 is a block diagram of a power delivery system, in accordance with another embodiment of the present invention.

FIG. 5 is a block diagram of a power delivery system 500, according to another embodiment of the present invention. In some applications, it is advantageous to have a surge current window which can be reactivated. For example, hard disk drives, due to their electric motors spinning up their disks, present inertial loads to a power delivery system. The hard disk drives usually go into a low power sleep mode after a period of inactivity, where the disks stop spinning. When a new activity is detected, the hard disk drive comes out of the low power mode and the disk need to spin up again. The current demand of a hard disk drive during this wake-up phase is similar to the current demand during the initial spin up of the disks, which is higher than the nominal operating current. Power delivery system 500 is adapted to, among other things, handle such load conditions.

Power delivery system 500 is shown as including a control block 505, a current sensing block 510, first and second comparators 515A and 515B, one-shot timer 520, and signal selector 525. Current sense block 510 is adapted to sense the output current $I_{Our}$ at its input terminal and generate a corresponding sense signal CSNS at its output terminal. Signal CSNS thus has a value representative of the value of sensed current $I_{OUT}$. Comparator 515A compares the sensed signal CSNS to reference signal CSNSREF1 that has a value representative of the value of a first reference current signal $I_{CSNSREF1}$. Comparator 515B compares the sensed signal CSNS to reference signal CSNSREF2 that has a value representative of the value of a second reference current signal $I_{CSNSREF2}$.

If signal CSNS is detected as being lower than signal CSNSREF1 (i.e., output current $I_{OUT}$ is detected as being lower than signal $I_{CSNSREF1}$) the output of comparator 515A is at a high level. If signal CSNS is detected as being higher than signal CSNSREF1, the output of comparator 515A is at a low level. Likewise, if signal CSNS is detected as being higher than signal CSNSREF2 (i.e., output current $I_{OUT}$ is detected as being higher than signal $I_{CSNSREF2}$), the output of comparator 515B is at a high level; and if signal CSNS is detected as being lower than signal CSNSREF2, the output of comparator 515B is at a low level.

The output signals of comparator 515B and 515A, namely signals CMPOUTB CMPOUTA, are respectively applied to input terminals TRIG and REARM of one-shot timer 520. One-shot timer 520 generates a logic signal at its output OUTOS, when it is triggered for the first time (via signal CMPOUTB generated by comparator 515B, i.e., the first occurrence of the low-to-high transition of signal CMPOUTB). One-shot timer 520 may also be triggered after it is rearmed (via signal CMPOUTA generated by comparator 515A) and then triggered again using signal CMPOUTB. The logic signal generated by one-shot timer 520 when so triggered stays high for a time period of $T_{OS}$. In other words, when the signal applied to the input terminal REARM of one-shot timer 520 makes, e.g., a low-to-high transition, the one-shot timer is rearmed and can be triggered again when its TRIG input signal makes, e.g., a low-to-high transition.

Signal selector 525 selects one of two current limit reference signals CLIMREF1 or CLIMREF2, in response to the output signal of the one-shot timer 520, and supplies the selected current limit reference signal to control block 505. The current limit level of control block 505 is set to $I_{CLIMREF2}$ when control block 205 receives signal CLIMREF2. The current limit level of control block 505 is set to $I_{CLIMREF1}$ when control block 505 receives signal CLIMREF1. Current limit level $I_{CLIMREF2}$ is higher than $I_{CLIMREF1}$. When output signal OUTOS of one-shot timer 520 is low (first logic state), signal selector 525 selects and supplies signal CLIMREF1 to input terminal CLIMREF of control block 505. When output signal OUTOS of one-shot timer 520 is high (second logic state), signal selector 525 selects and supplies signal CLIMREF2 to input terminal CLIMREF of control block 505.

According to one aspect of the present invention, current $I_{CSNSREF1}$ (which corresponds to reference sense signal CSNSREF1) is selected to be lower than current $I_{CSNSREF2}$ (which corresponds to reference signal CSNSREF2). Therefore, with proper selection of signal CSNSREF1, reliable detection of low-power sleep states of the load is achieved and the power delivery system 500 is rearmed each time the load goes into a low power sleep mode. Consequently, the surge current window is reactivated each time the load comes out of its sleep mode.

Figure 6:
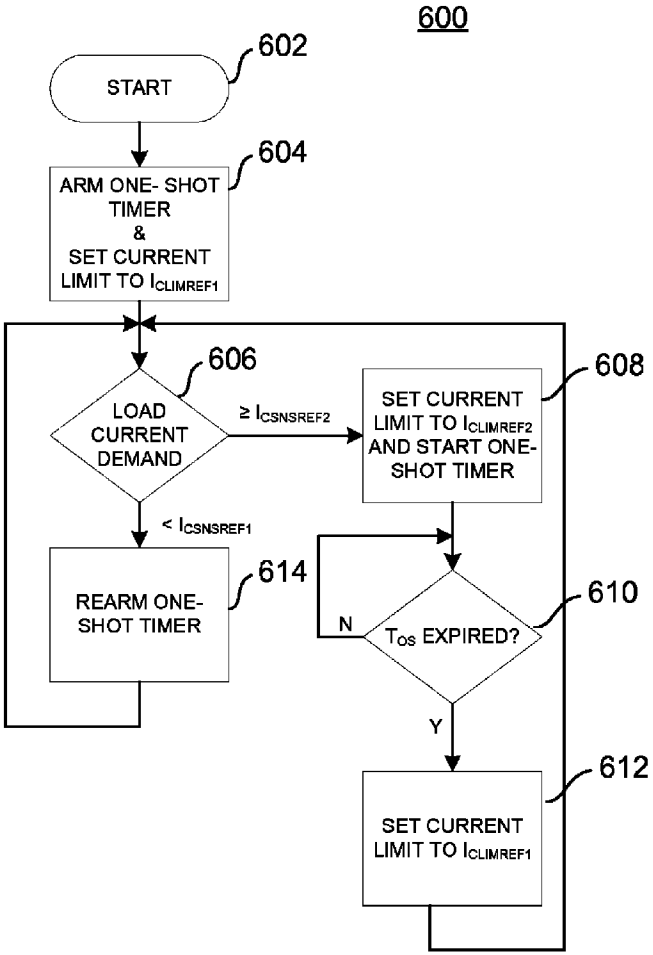
FIG. 6 is a flow chart of steps performed by a power delivery system, in accordance with another embodiment of the present invention.

FIG. 6 is a flowchart 600 of steps carried out by a power delivery system, in accordance with one embodiment of the present invention. At the start 602 of operation, which may be when the power delivery system 500 is turned on from an off state, a one-shot timer is armed and the current limit level is set 604 to a first level $I_{CLIMREF1}$. If the load current demand is sensed 606 to be equal to or greater than a reference current $I_{CSNSREF2}$, the one-shot timer is triggered and the current limit level is set 608 to $I_{CLIMREF2}$ for a period of $T_{OS}$ seconds.

When one-shot timer expires 610 (at the end of period $T_{OS}$) the current limit level is set back 612 to $I_{CLIMREF1}$. If the load current demand is sensed 606 to be below $I_{CSNSREF2}$ the one-shot timer is re-armed 614. Thus, if the load current demand becomes equal to or greater than $I_{CSNSREF2}$ again, the one-shot timer is retriggered and the current limit level is set to $I_{CLIMREF2}$ for the period of $T_{OS}$ again. Consequently, loads which require higher than nominal current levels during their start-up phase, and which go in and out of low-power sleep modes during the regular course of their operation, can be supported without compromising system protection against unexpected overload fault conditions.

Figure 7:
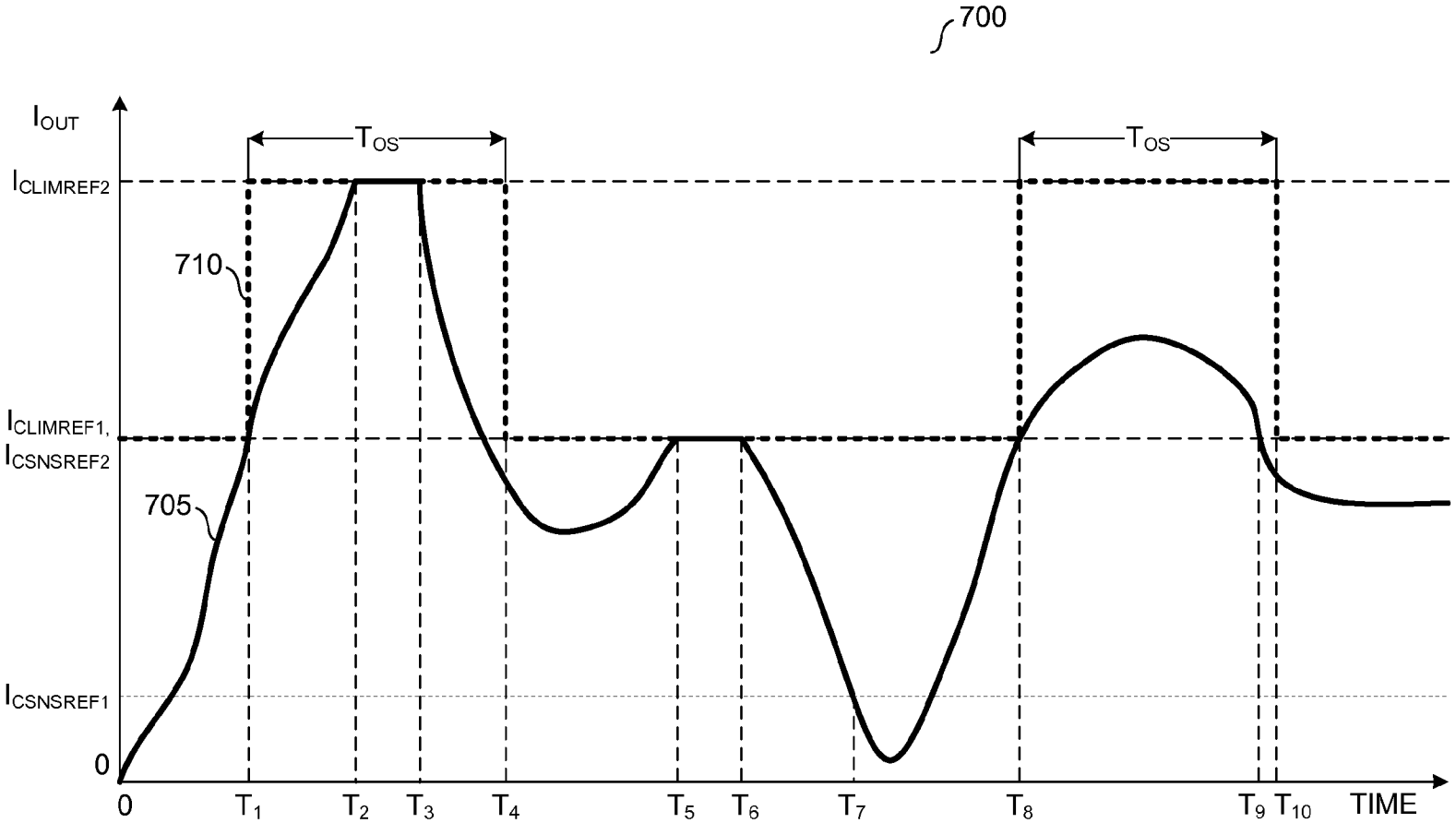
FIG. 7 is an exemplary timing diagram of a number of signals associated with the power delivery system of FIG. 5, in accordance with one embodiment of the present invention.

FIG. 7 is an exemplary timing diagram 700 of output current (solid line) 705 and the current limit level (dashed line) 710 of power delivery system 500. For simplicity, currents $I_{CLIMREF1}$ and $I_{CSNSREF2}$ are selected to be equal. At time zero, the current limit level is set to $I_{CLIMREF1}$ and the output current $I_{OUT}$ is shown as increasing. When $I_{OUT}$ reaches $I_{CSNSREF2}$ at time $T_1$, the current limit level increases from $I_{CLIMREF1}$ to $I_{CLIMREF2}$ for a period of $T_{OS}$ seconds. Between the times $T_2$ and $T_3$, the output current $I_{OUT}$ is limited to $I_{CLIMREF2}$ even though the load current demand exceeds $I_{CLIMREF2}$. Once $T_{OS}$ expires at time $T_4$, the current limit level reverts back to its nominal value of $I_{CLIMREF1}$. Subsequent load current demands in excess of $I_{CSNSREF2}$ do not activate the surge current window (i.e., do not increase the current limit level from $I_{CLIMREF1}$ to $I_{CLIMREF2}$) as long as $I_{OUT}$ remains above $I_{CSNSREF1}$. For example, during the periods $T_6$–$T_5$, the load current remains limited to $I_{CLIMREF1}$. Even though $I_{OUT}$ reaches $I_{CSNSREF2}$, the current limit level does not switch from $I_{CLIMREF1}$ to $I_{CLIMREF2}$. If however, $I_{OUT}$ falls below $I_{CSNSREF1}$, as is shown at time $T_7$, the one-shot timer is rearmed and can be triggered again. Thereafter, a subsequent $I_{OUT}$ increase above $I_{CSNSREF2}$ re-activates the surge current window, shown as causing the current limit level to increase from $I_{CLIMREF1}$ to $I_{CLIMREF2}$ at time $T_9$. Therefore, at time $T_8$, the load current is allowed to increase above $I_{CLIMREF1}$. At time $T_9$, the load current is shown as falling below $I_{CLIMREF1}$. At time $T_{10}$ the surge window is shown as closing ($T_{OS}$ expires). Accordingly, loads which require higher than nominal current levels during their start-up phase and, which go in-and-out of low-power sleep modes during the normal course of their operation, can be supported without compromising system protection against unexpected overload fault conditions.

The above embodiments of the present invention are illustrative and not limitative. Various alternatives and equivalents are possible. The invention is not limited by the type of current sensing, comparator, one-shot timer, signal selector, etc. used. The invention is not limited to particular logic states of the signals when asserted. For example, the one-shot timer may generate a high-to-low transition when triggered. A logic signal may be asserted when its output is at a logic low state or, alternatively at a logic high states. The invention is not limited by the type of integrated circuit in which the present disclosure may be disposed. Nor is the disclosure limited to any specific type of process technology, e.g., CMOS, Bipolar, or BICMOS that may be used to manufacture the present disclosure. Other additions, subtractions or modifications are obvious in view of the present disclosure and are intended to fall within the scope of the appended claims.

What is claimed is:

1. A power delivery system comprising:

a control block operative to receive power and, in response, deliver a current to a load;

a sensing circuit operative to sense the current delivered to the load and to generate a sensed signal in response;

a comparator operative to compare the sensed signal to a reference signal to generate a compare signal, said compare signal having a first value if the comparator detects that sensed signal is equal to or greater than the reference signal, said compare signal having a second value if the comparator detects that sensed signal is smaller than the reference signal;

a one-shot timer generating a logic signal that transitions from a first logic state to a second logic state for a predefined time period in response to a first occurrence of the first value of the compare signal;

a signal selector selecting a first current limit reference signal in response to the first logic state of the one-shot timer and a second current limit reference signal in response to the second logic state of the one-shot timer, said control block setting a first current limit for the current it delivers to the load in response to receiving the first current limit reference signal, and setting a second current limit for the current it delivers to the load in response to receiving the second current limit reference signal, said second current limit being higher than said first current limit.

2. The power delivery system of claim 1 wherein the reference signal received by the comparator has a value that is equal to a value of the first current limit reference signal selected by the signal selector.

3. A power delivery system comprising:

a control block operative to receive power and, in response, deliver a current to a load;

a sensing circuit operative to sense the current delivered to the load and to generate a sensed signal in response;

a first comparator operative to compare the sensed signal to a first reference signal to generate a first compare signal, said first compare signal having a first value if the first comparator detects that sensed signal is equal to or greater than the first reference signal, said first compare signal having a second value if the comparator detects that sensed signal is smaller than the first reference signal;

a second comparator operative to compare the sensed signal to a second reference signal to generate a second compare signal, said second compare signal having a first value if the second comparator detects that sensed signal is equal to or greater than the second reference signal, said second compare signal having a second value if the second comparator detects that sensed signal is smaller than the second reference signal;

a one-shot timer generating a logic signal that transitions from a first logic state to a second logic state for a predefined time period in response to a first occurrence of the first value of the first compare signal and further in response to each subsequent occurrence of the first value of the first compare signal if prior to or during each subsequent occurrence of the first value of the first compare signal the second compare signal receives the second value;

a signal selector selecting a first current limit reference signal in response to the first logic state of the one-shot timer and a second current limit reference signal in response to the second logic state of the one-shot timer, said control block setting a first current limit for the current it delivers to the load in response to receiving the first current limit reference signal, and setting a second current limit for the current it delivers to the load in response to receiving the second current limit reference signal, said second current limit being higher than said first current limit.

4. The power delivery system of claim 3 wherein the first current limit reference signal has a value equal to a value of the first reference signal.

5. The power delivery system of claim 3 wherein the first current limit reference signal, the first reference signal and the second reference signal have same values.

6. A method of limiting a current delivered to a load, the method comprising:

sensing the current delivered to the load to generate a compare signal;

setting the compare signal to a first value if the current delivered to the load is detected as being equal to or greater than a first current sense value;

setting the compare signal to a second value if the current delivered to the load is detected as being smaller than the first current sense value;

causing a logic signal to transition from a first logic state to a second logic state for a predefined time period in response to a first occurrence of the first value of the compare signal;

setting a first current limit value for the current delivered to the load in response to the first logic state of the logic signal; and setting a second current limit value for the current delivered to the load in response to the second logic state of the logic signal, said second current limit value being greater than the first current limit value.

7. The method of claim 6 further comprising:

setting the first current sense value equal to the first current limit value.

8. A method of limiting a current delivered to a load, the method comprising:

sensing the current delivered to the load to generate first and second compare signals;

setting the first compare signal to a first value if the current delivered to the load is detected as being equal to or greater than a first current sense value;

setting the first compare signal to a second value if the current delivered to the load is detected as being smaller than the first current sense value;

setting the second compare signal to a third value if the current delivered to the load is detected as being equal to or greater than a second current sense value;

setting the second compare signal to a fourth value if the current delivered to the load is detected as being smaller than the second current sense value;

causing a logic signal to transition from a first logic state to a second logic state for a predefined time period in response to a first occurrence of the first value of the first compare signal;

causing the logic signal to transition from the first logic state to the second logic state for the predefined time period in response to each subsequent occurrence of the first value of the first compare signal if prior to or during each subsequent occurrence of the first value of the first compare signal the second compare signal receives the fourth value;

setting a first current limit value for the current delivered to the load in response to the first logic state of the logic signal; and setting a second current limit value for the current delivered to the load in response to the second logic state of the logic signal, said second current limit value being greater than the first current limit value.

9. The method of claim 8 further comprising:

setting the first current sense value equal to the first current limit value.

10. The method of claim 9 further comprising:

setting the second current sense value equal to the first current limit value.

11. The power delivery system of claim 1 wherein the compare signal has the first value if the current delivered to the load is equal to or greater than the first current limit and the compare signal has the second value if the current delivered to the load is smaller than the first current limit.

12. The power delivery system of claim 3 wherein the first compare signal has the first value if the current delivered to the load is equal to or greater than the first current limit and the first compare signal has the second value if the current delivered to the load is smaller than the first current limit.

13. The method of claim 6 further comprising:

setting the compare signal to the first value if the current delivered to the load is equal to or greater than the first current limit value; and setting the compare signal to the second value if the current delivered to the load is smaller than the first current limit value.

14. The method of claim 8 further comprising:

setting the first compare signal to the first value if the current delivered to the load is equal to or greater than the first current limit value;

setting the first compare signal to the second value if the current delivered to the load is smaller than the first current limit value.

* * * * *